US006064045A

United States Patent [19]

Reichert et al.

[11] Patent Number: 6,064,045

[45] Date of Patent: May 16, 2000

[54] POWER CONTROL UNIT WITH AN APPLIANCE SWITCH CARRYING A SWITCHING CONTACT

[75] Inventors: Willi Reichert, Kürnbach; Siegfried Mannuss, Sternenfels, both of Germany

[73] Assignee: E.G.O. Elektro-Geratebau GmbH, Germany

[21] Appl. No.: 09/137,635

[22] Filed: Aug. 20, 1998

[30] Foreign Application Priority Data

Aug. 21, 1997 [DE] Germany ..... 197 36 308

[51] Int. Cl.[7] ..... H05B 3/02; H01H 61/08

[52] U.S. Cl. ..... 219/507; 337/94

[58] Field of Search ..... 219/507, 511, 219/512, 509, 490, 492, 493, 494, 497, 501; 337/107, 102, 94, 57, 361

[56] References Cited

U.S. PATENT DOCUMENTS

| | | | |
|---|---|---|---|
| 3,987,268 | 10/1976 | Maeda et al. | 219/622 |
| 4,206,344 | 6/1980 | Fischer et al. | 219/507 |
| 4,214,151 | 7/1980 | Kicherer et al. | 219/492 |
| 4,302,662 | 11/1981 | Kicherer et al. | 219/491 |
| 4,704,595 | 11/1987 | Essig et al. | 337/107 |
| 4,829,279 | 5/1989 | Kicherer et al. | 337/94 |

FOREIGN PATENT DOCUMENTS

| | | | |
|---|---|---|---|
| 0 682 352 A2 | 5/1995 | European Pat. Off. | H01H 37/10 |
| 19 30 935 | 6/1969 | Germany | H01H 3/42 |
| 1 565 682 | 3/1970 | Germany . | |
| 32 23 461 C2 | 6/1982 | Germany | H05B 1/02 |
| 36 39 186 A1 | 11/1986 | Germany | H05B 1/02 |
| 391 057 | 8/1965 | Switzerland . | |

*Primary Examiner*—Teresa Walberg
*Assistant Examiner*—Jeffrey Pwu
*Attorney, Agent, or Firm*—Quarles & Brady LLP

[57] ABSTRACT

For reducing the click rate and improving the setting accuracy, in the case of a power control unit (11) for electric heating appliances, a contact separation (D) of two contacts (14, 15) can be varied independently of a position change of an appliance switch (12) with a snap-action element (16). Preferably, the position of the counterstop (33) is modified by an application thereof to a separation cam disk (36). The appliance switch position is fixed by means of a power cam disk (28) and determines the power level.

In this way it is possible to randomly set within wide limits the click rite for each setting of the relative on period.

14 Claims, 4 Drawing Sheets

POWER CONTROL UNIT WITH AN APPLIANCE SWITCH CARRYING A SWITCHING CONTACT

FIELD OF USE AND PRIOR ART

The invention relates to a power control unit with an adjusting device for an appliance switch contained therein, particularly for electric heating appliances, whose position change leads to a change of a settable power level and which carries a switching contact, which engages in an "on" position on countercontact and in particular supplies the electric heating appliance with power, and in an "off" position with a variable contact separation with respect to the opposite contact engages on a counterstop.

The switching between the "on" and "off" positions is referred to hereinafter as "timing" and a single switching process is called "click".

Power control units which are at present commercially available are timed with a click rate of approximately four to five clicks per minute. By using commercially available loads (including inductive loads), which include electric heating appliances, maximum click rates of less than two clicks per minute are required. In addition, more stringent flicker regulations require a greater contact separation of switching contact and countercontact in the "off" position.

DE 36 39 186 describes an electric switching unit, in which by a position adjustment of an adjusting device, there is a simultaneous adjustment of the power level and the switching hysteresis or overlap. The power level is also known as the relative on period. In the case of a postion change of the adjusting device for modifying the power level by rotating a toggle, with the aid of a cam disk the entire adjusting device engaging on said cam disk, together with the counter-stop located thereon, undergoes a position change, which makes it possible to set the on period between 0% and 100%.

It is clear from FIGS. 8 and 9 and in particular FIG. 9 of DE 36 39 186, that for average power levels around 50%, the click rate is roughly twice that which can be reached in the low power range (up to 20%) and high power range (higher than 80%). It is only possible to reduce the click rate in the middle range by increasing the contact separation. However, due to the arrangement of the counterstop, it is not possible to increase or influence the trip or release path, which corresponds to the contact separation, without having a negative influence on the operation of the power control unit. At lower power levels, it would not be possible to release the appliance switch from the "off" position, because in the short time available, the releasing bimetal element cannot cover the necessary path. In a similar way, in the upper power range, with an increased contact separation, the bimetal element would require too much time to pass from its position to the "off" position of the contact. Thus, the desired high power level could not be reached.

PROBLEM AND SOLUTION

Therefore the problem of the invention is to provide a power control unit, which avoids the disadvantages of the prior art and which in particular makes the switching hysteresis randomly influenceable within certain limits, so that the click rate in the middle power range can be lowered, which permits a more accurate setting of a power level, especially in the lower and upper range, and which ensures a greater contact separation.

This problem is solved in that the adjusting device has a power adjusting device for the power level, a separate contact separation adjusting device and actuating means for the actuation thereof. This makes it possible to increase the contact separation over and beyond the normal amount independently of the power level, particularly in the middle power range, which leads to a reduction of the click rate here. Thus, the curve shown in FIG. 9 of DE 36 39 186 for the click rate can be modified in such a way that, for the same starting and end points, its height can be compressed, cf. also FIG. 4. This means that the click rate for middle power levels (approximately 50% on period ED) can be lowered to below two clicks per minute. As a result of this position change of the counterstop and/or opposite contact, which is independent of the power level, the click rate can generally be set substantially independently of the power level.

A mechanical power adjusting device is regarded as advantageous, especially a mechanical contact separation adjusting device as well. This can be achieved by a change of position or distance of assembly groups or functional units following a mechanical admittance.

For changing the position of the appliance switch, the power adjusting device advantageously has a power cam disk with varying radius, on whose external radius can be elastically pressed the appliance switch by a pretension. This manner of changing the position has the advantage that, an in principle random sequence of positions can be set. In this case, the external radius determines the appliance switch position.

In a preferred development of the invention, the contact separation adjusting device can have a separation cam disk with varying radius, on whose external radius can be elastically pressed by a pretension a device carrying and/or forming the counterstop, particularly an additional spring. This represents a simple manner of randomly setting the couterstop position change. The additional spring can be a leaf spring, whereof part is bent in such a way, that it forms the counterstop for the switching contact.

If both cam disks are fitted to a spindle, which is rotatable with an actuator by a user for setting the power level, the position change of both the appliance switch and the counter-stop can take place simultaneously. It is possible to use a single, stepped cam disk, which has two independently directed external radii corresponding to the two aforementioned external radii. The rotary movement of the actuator with the spindle can take place either in only one direction and in this case starting with the lowest power, or in both directions. It is possible to start either with the lowest power stage or by slight turning in the other direction it is possible to immediately set the highest power stage.

If at least one of the two external radii, preferably the external radius to which the appliance switch is applied, is provided with a reference system or the like, at least in portions thereof, a user is in this way informed of the particular setting range present. This is particularly advantageous when actuators are installed frontally below the hotplate, because in this case with a little practice the user is able to set the desired power level, without having to additionally look at the actuator position.

Advantageously, the external radii of the cam disks are shaped in matched manner for increasing the power setting accuracy at high and low power levels and decreasing the click rate at the middle level. Thus, the path of the two cam disks, gives the setting accuracy, the switching hysteresis and the path of the click rate over the on period.

In a preferred development of the invention, the external radius of the power cam disk can be at a maximum for a zero position of the power control unit and, from this portion, can decrease in a circumferential direction, opposite to the actuating direction of the power control unit, in a continuous manner to the zero position portion. The zero position portion can assume an arc of approximately 30°. This makes it possible to e.g. constantly increase the separation of the appliance switch from the opposite contact, which decreases the response sensitivity of the appliance switch, so that the click rate is low, particularly for high on period values ED. The external radius can decrease by approximately 30% between the position for the lowest power level and that for the highest power level. At the highest power level position, an increased, additional reduction of the external radius can be advantageous, so as to achieve a clear rise in the on period value ED for a limited adjustment path.

In a particularly advantageous manner, the external radius of the separation cam disk is at a maximum for a zero position of the power control unit and then decreases from this portion in a direction opposite to the actuating direction to a second portion, which roughly faces the first portion and has a minimum external radius, and increases as from this point in a third portion up to the zero position portion. Thus, only in the first portion does the adjustment of the counterstop take place roughly proportionally to the position change of the appliance switch. As a result of the external radius increasing in the third portion, the counterstop returns in the direction of its original position for a low power level, so that the setting accuracy is approximately the same in both ranges. A reduction of the external radius to approximately 70% in the vicinity of the second portion is considered particularly advantageous for the application of the invention, because the click rate is adequately reduced.

Preferably, the appliance switch is constructed as a snap-action switch, particularly with a two-piece, bistable snap-action spring, which loads the switching contact against at least one switching position. Thus, the contacts are securely and reliably switched and also kept in their relevant switching position, i.e. either in the "on" position or the "off" position. Snap-action springs have in particular the advantage that they very rapidly perform the switching process with a minimum of radio interference or contact burn.

If the snap-action spring has an impact fork, the switching processes of the contacts are improved. It is particularly advantageous to use a two-piece impact spring with an impact fork, which performs the switching processes particularly rapidly in both directions. This avoids disturbing contact burn or a sticking of contacts and further reduces radio interference.

These and further features of the invention can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subtitles in no way limit the general validity of the statements made thereunder.

BRIEF DESCRIPTION OF THE DRAWINGS

An embodiment of the invention is described in greater detail hereinafter relative to the drawings, wherein show.

DESCRIPTION OF A PREFERRED EMBODIMENT

Figure 1:
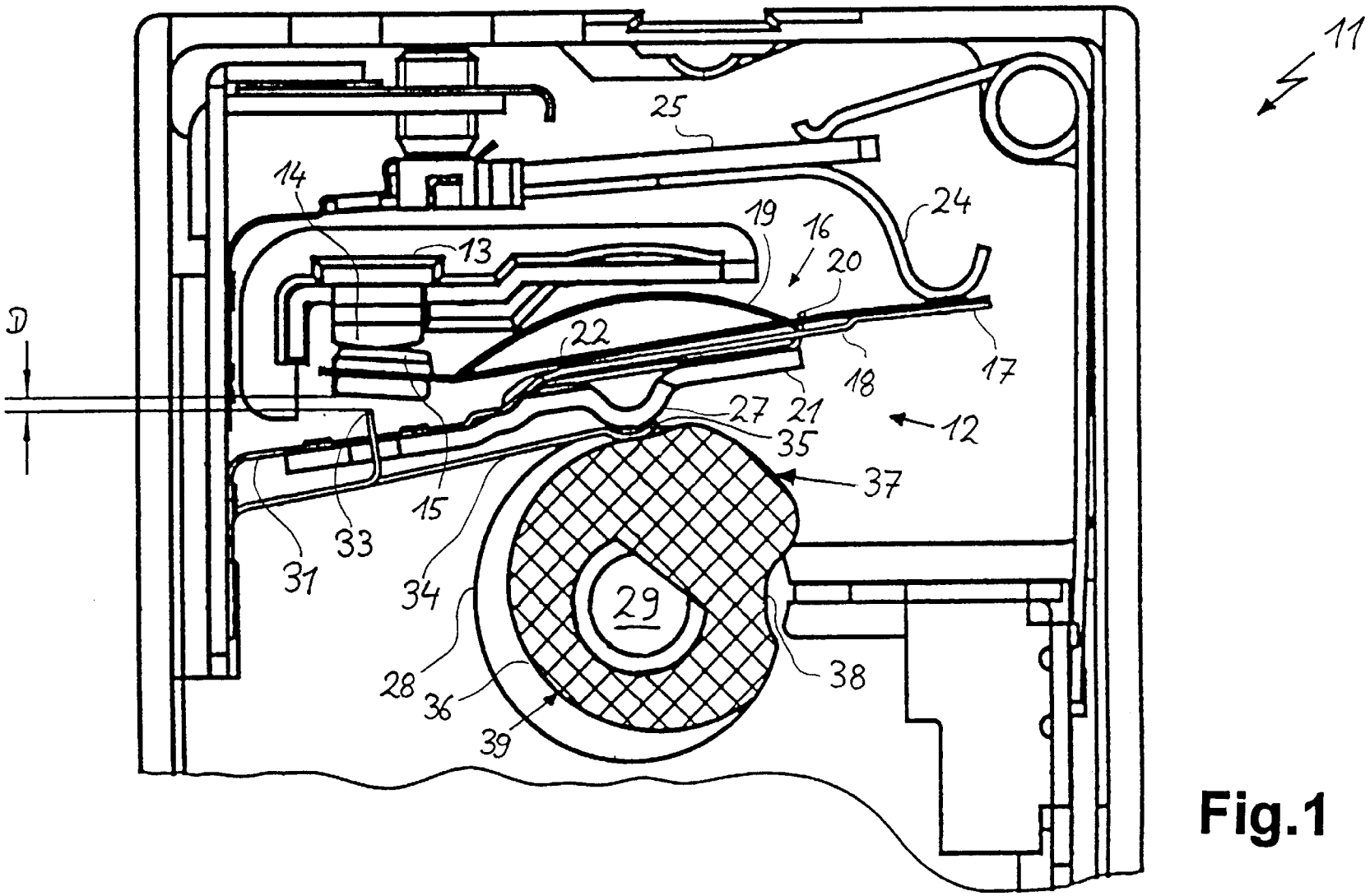
FIG. 1 An inside view of an inventive control unit with an adjusting device, engaging on the external radii of to cam disks, the contact of an appliance switch being closed at a low power level.

FIG. 1 shows an inside view of a timing power control unit 11 for electric heating appliances. It has an appliance switch 12, which forms the contact to be closed. This contact comprises a rounded opposite contact 14 fixed to a stationary contact bridge and a switching contact 15, which is fixed to the appliance switch 12. The switching contact 15 is a conventionally used cup-shaped contact head, which is fixed by riveting.

The switching contact 15 is fixed to one end of an elongated, bistable snap-action spring 16 and projects bilaterally beyond the latter. The snap-action spring has two elongated, hairpin-shaped arms 22, which at the end 17 opposite to the switching contact 15 are fixed to a support 18. Between the arms 22 of the snap-action spring 16 passes a snap-action bow 19 which, close to the end of the spring carrying the switching contact 15 is bent upwards in the direction of the free end 17 and is applied there under pretension and in arcuately curved manner to an abutment 20. Said abutment is fixed to a support plate 21 and is preferably formed by part of the support 18 fixed to the support plate 21.

In principle, the function of the appliance switch is as follows. If the point at which the snap-action bow 19 engages on the abutment 20 is above the plane of the two hairpin-shaped arms 22 of the snap-action spring 16, then the latter is in a first position. The switching contact 15 is thereby pressed against the opposite contact 14. If pressure is now exerted on the free end 17 of the snap-action spring 16 and the latter is deflected downwards corresponding to FIG. 1, the point of engagement of the snap-action bow 19 in abutment 20 approaches the plane of the arm 22. If now the movable arms 22 of the snap-action spring 16 are pressed under the reversing point fixed by the fixed position of the support plate 21, the snap-action spring snaps round. This means that the end of the snap-action spring 16 carrying the switching contact 15 is bent away suddenly downwards by the snap-action bow. Thus, the switching contact 15 no longer engages on the opposite contact 14 and the contact or appliance switch 12 is opened in a second position.

The switching process of the snap-action spring 16 is triggered by an actuator in the form of a curved bimetal strip 24. The latter carries on a top side remote from the snap-action spring 16 an which is largely linearly directed, a heating element 25 or the like. By means of a hook-shaped bent end, the bimetal strip 24 engages on the free end 17 of the snap-action spring 16. The combination of the two metals bringing about the bimetal effect is chosen in such a way that the metal with the higher expansion coefficient is located on the side of the bimetal strip engaging on the heating element 25. Current only flows through the heating element 25 when the contact between the switching contact 15 and opposite contact 14 is close and in this way the parallel-connected electric heating appliance is supplied with power. If the contact is closed, the heating element 25 heats the bimetal strip 24, which changes its shape and, as a result of increasing curvature in the direction of the snap-action spring 16, presses on the free end 17 of the latter.

After a certain time, indicated by a rise in the heat build-up in the heating element 25 and/or a shape change of the bimetal strip 24, the free end 17 of the snap-action spring 16 has been pressed downwards to such an extent that the arm 22 is located below the reversing point, whereupon the snap-action spring snaps round and the switching contact 15 is released from the opposite contact 14. Simultaneously the power supply to the heating element 25 and to the electric heating appliance is interrupted and as a result of the incipient cooling the bimetal strip 24 migrates back to its starting position. On passing beyond the reversing point, the snap-action spring 16 snaps back again, the switching contact 15 engages on the opposite contact 14 and the heating process starts anew.

To modify the settable power desired by a user, it is necessary to time the power supply for the electric heating appliance, because to the latter is always applied the mains voltage and consequently the power cannot be directly changed. This means that during a specific time interval, the switched voltage is applied to the electric heating appliance and during a specific time interval independent thereof no voltage is applied. The sum of these two periods gives a cycle duration. The ratio of the time interval, in which the contact is closed and voltage applied to the electric heating appliance, to the cycle duration is called the relative on period. As is apparent from the above statements, the time period in the on state is dependent on the path which has to be covered by the free end 17 until the snap-action spring 16 snaps round.

In known-manner, a change to this path length is achieved in that the support plate 21, which carries the snap-action spring 16, is pressed with a projection 27 against the external radius of a power cam disk 28, which is located on a spindle 29. As a result the power adjusting device is formed and the spindle 29 forms the actuator.

Pressing takes place by means of a resilient metal element 31, bent roughly at right angles and which is fixed by an arm to the casing of the power control unit 11 and to whose other arm is fixed the support plate 21. This metal element 31 is so pretensioned, that the support plate 21 engages with the external radius of the power cam disk 28. According to the description, this power cam disk 28 has a variable radius. As a result of user turning the spindle 29, as a function of the set position, the projection 27 engages on a different point on the outer circumference of the power cam disk 28, and as a function of the radius of the disk at this point the support plate 21 and consequently the snap-action spring 16 is in a specific position with respect to the opposite contact 14 and the bimetal strip 24.

In a low power stage position, the power cam disk radius is large, so that the free end 17 is close to the bimetal strip 24 and the latter, after only a short time, can bring about a reversing of the snap-action spring 16 and consequently a separation of the contacts 14 and 15. In a high power position, the power cam disk 28 has a small radius, so that the free end 17 is a longer distance from the bimetal strip 24. As a result the latter must cover a greater distance (corresponds to a longer time period), in order to snap round the snap-action spring 16.

When the contact is open, the switching contact 15 engages with its side remote from the opposite contact 14 on a counterstop 33. The distance between the switching contact 15 and the counterstop 33 is designated D and determines the extent to which the snap-action spring 16 snaps round following the actuation of its free end 17. The greater D, the lower the arms 22 after snapping round below the abutment 20 and consequently the bimetal strip 24 must travel further upwards in order to reach the reversing point.

According to the present invention, the variable contact separation D is reached in that the counterstop 33 is part of a wiper 34, which is fixed by an angled end to the casing of the power control unit and whose other, free end 35 is slightly hook-shaped. It engages on the external radius of a second separation cam disk 36, which is adjacent to the first cam disk 28 on the spindle 29, so as to form the separation adjusting device.

According to the description, the separation cam disk 36 also has a variable radius. Through the resilient fixing of the wiper 34 to the casing, the latter is pressed in all positions against the external radius of the separation cam disk 36. Consequently the counterstop 33 changes its position as a function of the radius of the separation cam disk 36.

The form or shape of the cam disks 28 and 36 is described hereinafter The power cam disk 28 has an external radius configuration known for such uses. In a zero position of the power control unit 11 the radius is at a maximum and then decreases continuously to a point for a maximum power 38, where it has an additional inward indentation. As a result of its reduced radius, this indentation 38 not only considerably reduces the average power output, but also provides a user with a clearly detactable acknowledgement to the effect that the top power stage is set. The indentation 38 is followed by the zero position portion 37.

The configuration of the separation cam disk 36, in the vicinity of the portion 37, corresponds to the power cam disk 28. The radius then decreases somewhat more compared with the portion 37 up to a second portion 39 than in the case of the power cam disk 28 and from there rises again continuously to a third portion corresponding to the indentation 38. This means that the radius initially decreases and then increases.

As a result of the above-described configuration of the separation cam disk 36, the contact separation D is small in the ranges where a high setting accuracy and a reliable operation of the appliance switch are required. These are the lower and upper power ranges. In the middle power range, where the setting accuracy demands are lower, but the click rate must be reduced, the contact separation D is greater.

FIG. 2 again shows the power control unit 11 of FIG. 1. However, the setting of the power from a low power in FIG. 1 has been changed to a medium or middle power by turning the spindle 29. This is apparent from the fact that the projection 27 and the end of the wiper 34 are now in the portion 39 of the corresponding cam disk, which roughly faces the zero position portion 37. Compared with FIG. 1, it is clear that the end 35 of the wiper 34 is much further from the snap-action spring 16 than the projection 27 of the support plate 21. It can also be seen that the arm 22 of the snap-action spring 16 is further above the reversing point on abutment 20 than in FIG. 1. This means that the free end 17 of the snap-action spring 16 must be pressed further downwards for said spring to snap round. The function is the same as in FIG. 1.

Figure 2:
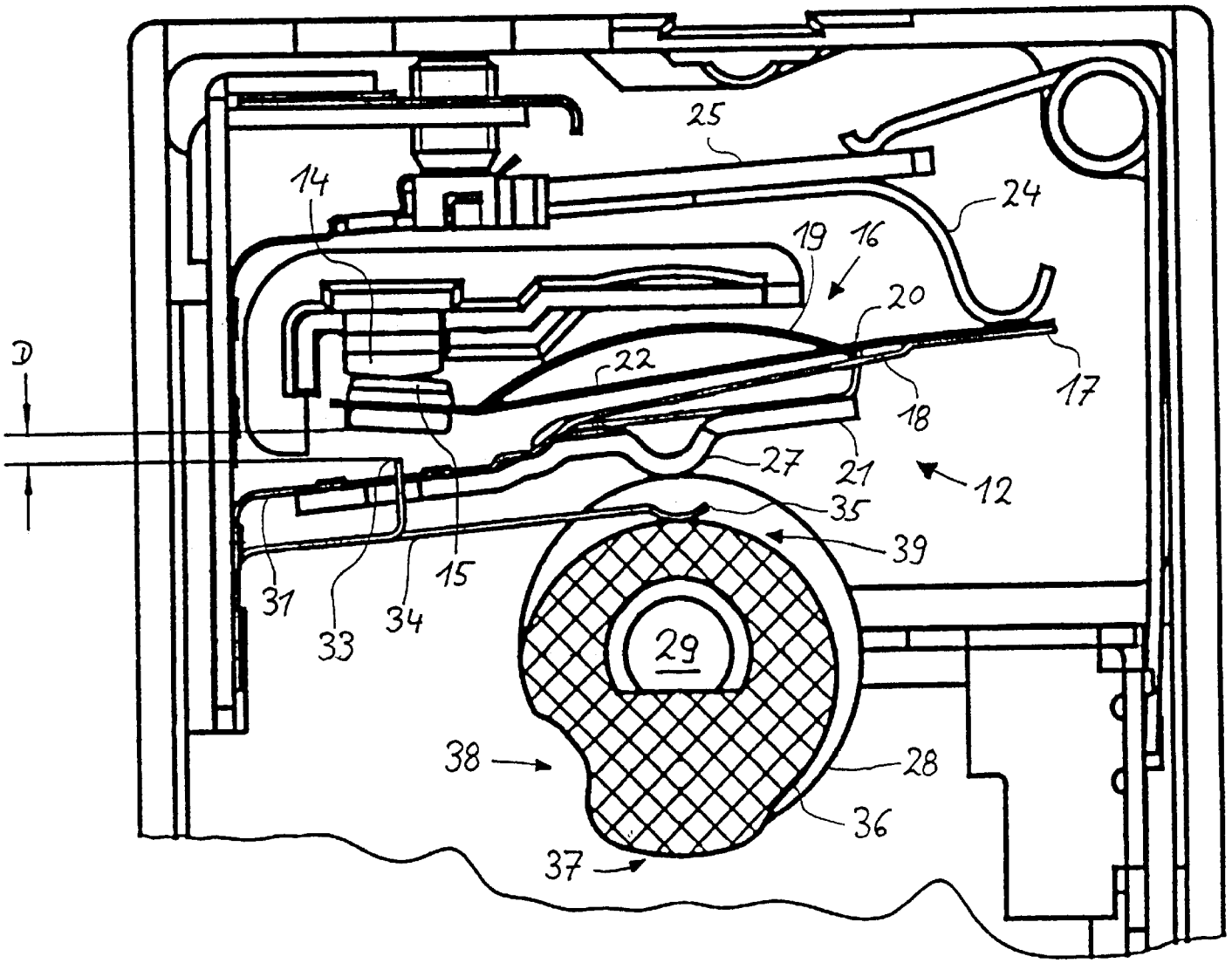
FIG. 2 The same view as in FIG. 1 with the setting of a medium power level.
Figure 3:
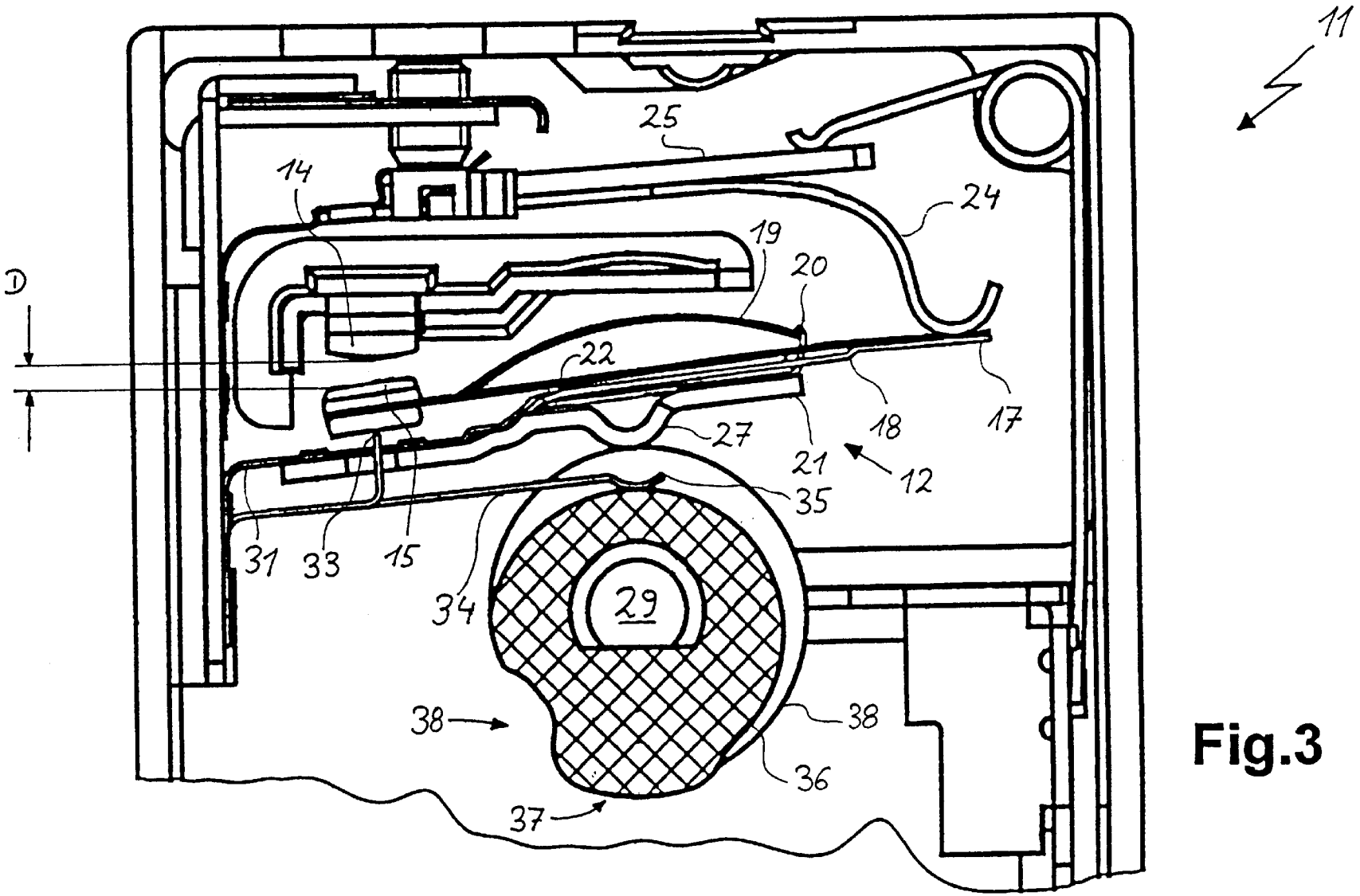
FIG. 3 The view of FIG. 2 with the switching contact open.

FIG. 3 show the power control unit 11 with the power setting of FIG. 2, but in a position in which the snap-action spring 16 has snapped round and the switching contact 15 has separated from th opposite contact 14. The back of the switching contact 15 now engages on the counterstop 33. It is clear that the arms 22 of the snap-action spring 16 are below the abutment 20 The inventive adjustment of the contact separation through the movable opposite contact 33 is made particularly clear by FIG. 3. As a result of the variable radii of the cam disk 28 and 36, not only is there a change in the position of the appliance switch 12 relative to the bimetal strip 24, but also there is a change in the relative position between the counterstop 33 and the support plate 21 or the position where the counterstop 33 is closest to the support plate 21.

If the position of the power cam disk 28 is considered to be predetermine and the radius of the separation cam disk 36 is varied in the middle range 39, it can be seen that there is a change in the position of the switching contact 15 relative to the opposite contact 14. There is also a change in the separation between the arms 22 and the abutment 20. As a result of the variable counterstop 33, it is possible to set the point at which the snap-action spring 16 closes the contacts again and also the contact separation between the switching contact 15 and opposite contact 14. This separation corresponds to the separation D between the back of the switching contact 15 and the counterstop 33. With the configuration of the cam disks 28 and 36 shown in the drawings, the contact separation D in the lower and upper power ranges is small, but large in the middle power range.

The wiper 3 is preferably made from the same resilient material as the snap-action spring 16. The counterstop 33 is formed by the right-angled bending of a portion in the direction of the switching contact 15. It can project through a cutout in the support plate 21.

Figure 4:
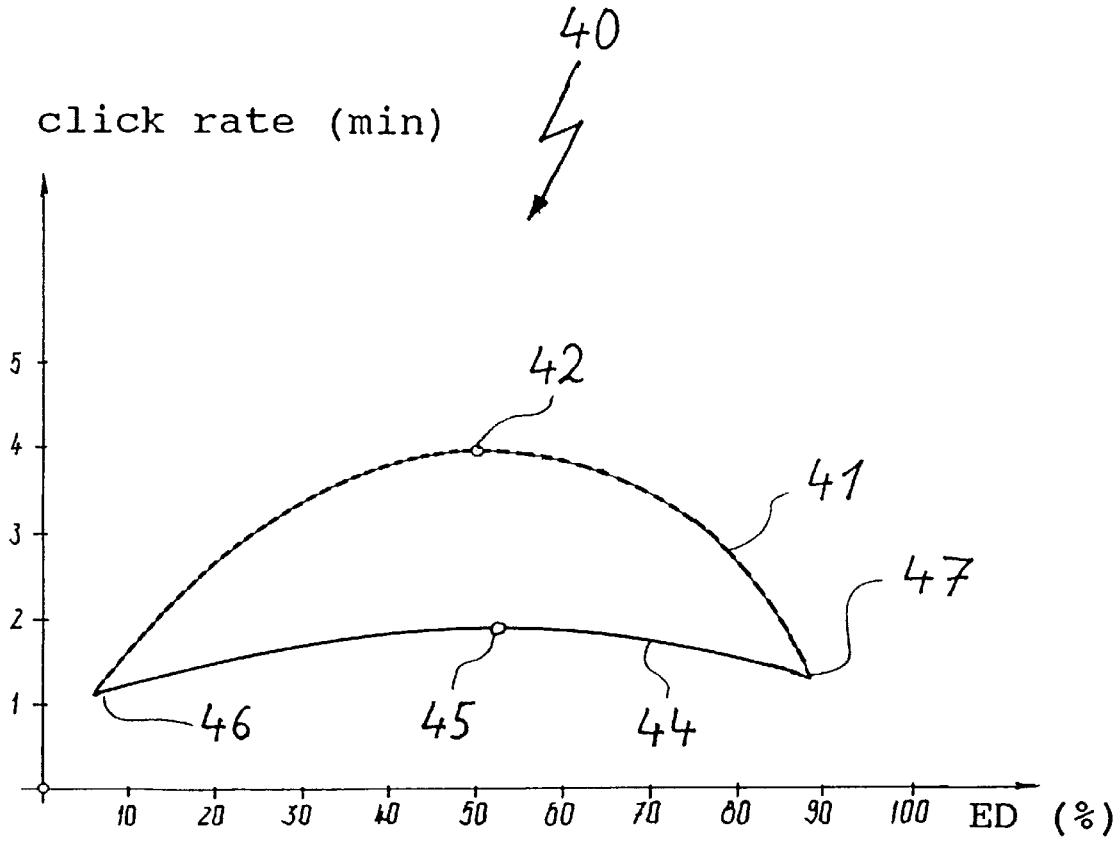
FIG. 4 The click rate curves corresponding to the prior art and the present invention.

FIG. 4 is a diagram 40 showing the click rates over the on period ED, representing a broken line click rate curve 41 of a prior art power control unit. It starts at a starting point or origin 46 with a low click rate of approximately one click per minute and then, with rising on period ED is upwardly curved in cam-shaped manner and reaches at its top point 42 a click rate of over four clicks per minute. As from an on period ED of approximately 50%, the curve 41 drops again to an end point 47 with a click rate of approximately one click per minute.

The continuous click rate curve 44 of the power control unit 11 according to the invention also starts at the origin 46, but then rises to a lesser extent to a top point 45, at slightly less than two clicks per minute and then drops from there to the end point 47. The drop in the click rate in the middle power range is clear.

The choice of starting and end points 46 and 47 with the same click rates is of an arbitrary nature, but is regarded as favourable. By varying the radii of the two cam disks, the click rate curve is largely randomly settable. Other cam-like curved configurations, e.g. linear configurations are also conceivable. It is merely necessary to have a corresponding external radius of the separation cam disk 36.

What is claimed is:

1. A power control unit for electric heating appliances, said power control unit including an appliance switch, a position change of said appliance switch changing a setable power level of said power control unit, said setable power level having a range from a lower to a middle to an upper power level, said appliance switch comprising:

a switching contact, said switching contact positionable between 'on' and 'off' positions;

an opposite contact;

a counterstop with a variable contact separation distance (D) with respect to said opposite contact, said switching contact in said 'on' position engaging said opposite contact and supplying power to the electric heating appliance, and said switching contact in said 'off' position engaging said counterstop, said contact separation distance (D) at said middle power level is greater than said contact separation distance (D) at said lower and upper power levels; and, an adjusting device, said adjusting device comprising:

a power adjusting device for said power level, a contact separation adjusting device for adjusting the contact separation distance (D), said contact separation adjusting device separate from said power adjusting device, and actuating means for actuating said power adjusting device and said contact separation device.

2. The power control unit according to claim 1, wherein both said power adjusting device and said contact separation adjusting device can be simultaneously operated with a common actuator.

3. The power control unit according to claim 1, wherein a change of position as a consequence of a mechanical admittance controls said power adjusting device.

4. The power control unit according to claim 1, wherein a change of position as a consequence of mechanical admittance controls said contact separation adjusting device.

5. The power control unit according to claim 1, wherein said power adjusting device includes a power cam disk having a varying radius, said appliance switch being elastically pressed by a pretension on an external radius of said power cam disk.

6. The power control unit according to claim 5, wherein a maximum external radius of said power cam disk is at a zero position of said power control unit, said external radius continuously decreases to said zero position in a circumferential direction opposed to an actuating direction of said power control unit starting with low power level.

7. The power control unit according to claim 1, wherein said contact separation adjusting device includes a separation cam disk having a varying radius, a portion of said counterstop being elastically pressed by a pretension on an external radius of said separation cam disk.

8. The power control unit according to claim 7, wherein said portion of said counterstop is an additional spring.

9. The power control unit according to claim 7, wherein a first portion having a maximum external radius of said separation cam disk is at a zero position of said power control unit, said external radius decreasing from said first portion in a direction opposed to an actuating direction starting with low power level to a second portion facing said first portion and having a minimum external radius, said external radius increasing from said second portion to a third portion.

10. The power control unit according to claim 1, wherein said contact separation adjusting device includes a separation cam disk having a varying radius, a device carrying said counterstop being elastically pressed by a pretension on an external radius of said separation cam disk.

11. The power control unit according to claim 1, wherein said power adjusting device comprises a power cam disk having a varying radius and said contact separation adjusting device comprises a separation cam disk having a varying radius, both said cam disks being fitted to a spindle, said spindle being turnable with an actuator by a user.

12. The power control unit according to claim 1, wherein said appliance switch is a snap-action switch to loading said switching contact against at least one switching position.

13. The power control unit according to claim 12, wherein said appliance switch is a snap-action switch comprising a two-part, bistable snap-action spring.

14. The power control unit according to claim 13, wherein said snap-action spring comprises an impact fork for improving the switching processes of the contacts.

* * * * *